US006334412B1

(12) United States Patent
Kaita

(10) Patent No.: US 6,334,412 B1
(45) Date of Patent: Jan. 1, 2002

(54) MONO-BLOCK CYLINDER HEAD STRUCTURE OF WATER COOLED ENGINE

(75) Inventor: Keiji Kaita, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/650,676

(22) Filed: Aug. 30, 2000

(51) Int. Cl.[7] ..... F01B 11/02
(52) U.S. Cl. ..... 123/41.82 R; 123/193.3
(58) Field of Search ..... 123/41.82 R, 193.3, 123/193.5

(56) References Cited

U.S. PATENT DOCUMENTS 3,674,000 A * 7/1972 Reisacher et al. ..... 123/193.3
3,691,914 A * 9/1972 Reisacher et al. ..... 123/41.82
4,630,345 A * 12/1986 Lutz ..... 123/193.3
5,404,846 A * 4/1995 Vanrens ..... 123/193.3
6,158,402 A * 12/2000 Taguchi et al. ..... 123/53.1

FOREIGN PATENT DOCUMENTS

JP 6-40336 5/1994

* cited by examiner

*Primary Examiner*—Marguerite McMahon
(74) *Attorney, Agent, or Firm*—Oliff & Berridge PLC

(57) ABSTRACT

The object of the present invention is to provide a mono-block cylinder head structure of a water cooled engine which can effectively prevent a reduction in strength of a joint portion due to a concentration of stress of a combustion load on the joint portion between a cylinder portion and a cylinder head ceiling portion without reducing the cooling efficiency by a water jacket, the structure being provided with a water jacket having a water jacket outer wall covering a cylinder upper end portion and a cylinder head ceiling portion in a water cooled engine wherein a reinforcing rib is provided in said Joint portion with said cylinder upper end portion and said cylinder ceiling portion to hold the load generated by combustion in a combustion chamber in said cylinder and release the beat generated by said combustion to a water jacket.

8 Claims, 7 Drawing Sheets

MONO-BLOCK CYLINDER HEAD STRUCTURE OF WATER COOLED ENGINE

BACKGROUND OF THE INVENTION

1. Field of the Invention

The present invention relates to a mono-block cylinder head structure of a water cooled engine, and more particularly, to a mono-block cylinder head structure of a water cooled engine wherein a mono-block cylinder head portion which constitutes a water cooled engine is provided with a reinforcing rib.

2. Description of the Related Art

In recent years, there have been adopted many mono-block cylinders for aircraft engines.

In producing the engine body, in general, as shown in FIG. 6, an engine body 43 is constituted by joining a cylinder block 40 and a cylinder head 41 with bolts through a cylinder head gasket 42. In the figure, reference numeral 44 denotes a head cover, and reference numeral 45 denotes an oil pan.

The mono-block cylinder is made by integrally molding a cylinder portion and a cylinder head of a cylinder block, which obviates the need for a plurality of bolt boss portions, corresponding bolts and cylinder gaskets for joining the cylinder block and the cylinder head which are necessary when the cylinder block and the cylinder head are separated from each other. Thus, as it is possible to make the engine body lightweight, which is why such mono-block cylinders are much adopted, especially in aircraft engines.

In the mono-block cylinder head 46 of a water cooled engine, as shown in FIG. 7, a water jacket outer wall portion 50 is provided on a cylinder head portion 47 from an upper end of a cylinder wall portion 48 to a cylinder head ceiling portion 49 with a predetermined space between the cylinder wall portion 48 and the cylinder head ceiling portion 49. A water jacket 51 is then formed with cooling liquid stored between the cylinder wall portion 48 and the cylinder head ceiling portion 49.

In such a mono-block cylinder 46, combustion load generated during combustion in a cylinder body 53 acts in concentration on a joint portion 52 between the cylinder head ceiling portion 49 and the cylinder wall portion 48.

In order to avoid this situation there may be, for example, a method for enlarging a thickness of the above cylinder head ceiling portion 49 or the cylinder wall portion 48, or for expanding a radius of curvature of the above joint portion 52.

However, when the wall thickness is set large, the cylinder head portion 47 including the joint portion 52 shows a temperature increase during combustion because the cooling effect by the cooling liquid in the water jacket 51 is decreased. Consequently, such a temperature increase may bring about a loss in material strength of the joint portion 52 and induce non-uniformity of heat distribution in the cylinder head portion 47, and reduce the strength of the cylinder head portion 47 itself.

Further, when the radius of curvature of the joint portion 52 is made larger, it is necessary to make an escape of the end portion of pistons larger to correspond to the inner shape of the joint portion 52, thereby there was a possibility to lower a combustion efficiency and lower the engine performance such as fuel consumption, etc.

In particular, when the cylinder block is cast with aluminum alloy, the temperature of the combustion chamber side wall portion in the cylinder head portion 47 becomes 200° C. to 300° C. during combustion. However, since the strength of aluminum rapidly declines from about 150° C., the aforementioned condition becomes noticeable, such that some countermeasure has been desired.

SUMMARY OF THE INVENTION

In view of this, an object of the present invention is to provide a mono-block cylinder head structure of water cooled engine that makes it impossible to effectively prevent a reduction in strength of a joint portion due to a concentration of stress from a combustion load on the joint portion between a cylinder portion and a cylinder head ceiling portion without reducing the cooling efficiency by a water jacket.

Further, another object of the present invention is to provide a mono-block cylinder head structure of a water cooled engine which aims to alleviate uneven thermal stress by improving thermal uniformity in a cylinder body, while also enabling the cooling efficiency to be improved.

In order to solve the foregoing objects, in the invention, there is provided a mono-block cylinder head structure provided with a water jacket having a water jacket outer wall portion 14 covering a cylinder upper end portion 12 and a cylinder head ceiling portion 13 of a cooling-water type engine, comprising a reinforcing rib 19, which can hold a load generated by combustion in a combustion chamber 18 formed in a cylinder 21 and which can release heat generated by combustion to the water jacket 11, at a joint portion 16 between the cylinder upper end portion 12 and the cylinder head ceiling portion 13.

Accordingly, in the invention, even when a combustion load is generated by combustion in the combustion chamber 18 formed in the engine cylinder 21 and acts upon the joint portion 16 between the cylinder upper end portion 12 and the cylinder head ceiling portion 13, the reinforcing rib 19 which can hold the load generated by combustion enables the joint portion 16 to sufficiently withstand the generated stress, so that a loss in strength in the joint portion 16 can be prevented. Furthermore, as the heat generated in the combustion chamber 18 formed in the cylinder 21 can be radiated to the water jacket 11, there is no loss in cooling effect by the water jacket 11.

Consequently, in the invention, a loss in strength in the joint portion 16 between the cylinder upper end portion 12 and the cylinder head ceiling portion 13 can be effectively prevented without lowering the cooling efficiency by the water jacket 11.

According to one form of the invention, there is provided a mono-block cylinder head structure of a water cooled engine provided with a water jacket 11 having a water jacket outer wall portion 14 covering the cylinder upper end portion 12 and the cylinder head ceiling portion 13, comprising a reinforcing rib 19, which is formed so as to be continuously rising from the cylinder upper end portion 12 at the joint portion 16 between the above cylinder upper end portion 12 and the cylinder head ceiling portion 13 in the water jacket 11, for joining a space between the joint portion 16 and the water jacket outer side wall 14.

Accordingly, in this form of the invention, when stress by combustion load generated in the combustion chamber 18 of the cylinder 21 has acted on the above joint portion 16, the stress is retained by the joint portion 16 and the reinforcing rib 19. Furthermore, the stress is input to the water jacket outer wall portion 14 through the reinforcing rib 19 and is hold also by the water jacket outer wall portion 14. Accordingly, since it is possible to distribute and hold at the plural portions the stress generated by the combustion load, the stress caused by the combustion load does not concentrate on the joint portion 16.

As a result, a loss of strength in the joint portion 16 can be effectively prevented.

Also, as the reinforcing rib 19 is joined to the water jacket outer wall portion 14, it can effectively transfer the heat generated in the combustion chamber 18 to the water jacket 11 side without the heat remaining within the reinforcing rib 19, and thus can prevent the cooling efficiency of the cylinder head 15 from being reduced.

In a yet another form of the invention, the reinforcing ribs 19 are disposed radially in a plane over the entire area in the peripheral direction of the combustion chamber 18 with predetermined intervals therebetween.

Accordingly, in this form of the invention, since the reinforcing ribs 19 are disposed radially in a plane over the entire area in the peripheral direction of the combustion chamber 18 with predetermined intervals therebetween, a plurality of radially disposed ribs 19 sustain the combustion load generated at the central portion in the combustion chamber 18, and further, can transfer the stress radially to the water jacket outer wall portion 14, such that it is possible to reliably distribute and hold the generated stress at the plural portions.

In still yet another form of the invention, the reinforcing ribs 19 are formed in a continuous planar annulus ring shape over the entire area in the peripheral direction of the cylinder head ceiling portion 13 on the outside of the cylinder head ceiling portion 13, the water jacket 11 is formed in division into the inner water jacket portion 33 and the outer water jacket portion 34, and the cooling liquid for the inner water jacket portion 33 is able to circulate in the outer water jacket portion 34.

Accordingly, the inner water jacket portion 33 is positioned at a cylinder head ceiling wall central portion 35, and the outer water jacket 34 is positioned at a cylinder upper end portion 37 whose temperature is lower than that of the central portion.

As a result, the cooling liquid inside the water jacket 11 circulates in the inner water jacket portion 33 disposed at the cylinder head ceiling wall portion 35 having a high temperature to cool a cylinder head ceiling wall portion 35, and thereafter the cooling liquid which showed a temperature increase to a predetermined temperature by heat exchange circulates into the outer water jacket portion 34 and cools the cylinder upper end portion 37. In this case, as the cylinder upper end portion 37 has a relatively lower combustion temperature than does the cylinder head ceiling wall central portion 35, even when the cooling liquid temperature has risen to the predetermined temperature, the cooling action is not impaired.

As a result, it is possible to achieve sufficient cooling by supplying a cooling liquid of the lowest temperature to the cylinder upper end portion 37 which has the highest temperature and the greatest need for cooling, while supplying a cooling liquid of not so low a temperature to the cylinder upper end portion 37 which does not have as high a temperature as the cylinder head ceiling wall central portion 35. As a result, cooling efficiency of the entire cylinder head 15 can be improved.

Furthermore, as it is possible to cool the cylinder head 15 by flowing the cooling liquid used for cooling the cylinder head ceiling wall central portion 36 at the cylinder head upper end portion 36 of the water jacket 11 directly into around the cylinder head upper end portion 37, it is possible to cool the cylinder head 15 with high cooling efficiency by effectively utilizing the cooling liquid.

Moreover, as described above, it is possible to achieve sufficient cooling by supplying the cooling liquid of the lowest temperature to the cylinder head ceiling wall central portion 35 which has the highest temperature and the largest need for cooling, while supplying the cooling liquid of not so low a temperature to around the cylinder upper end portion 37 which does not have as high a temperature as the cylinder head ceiling wall central portion 35. As a result, it becomes possible to make the thermal distribution of the cylinder head 15 uniform by cooling. Therefore it is possible to aim to alleviate the thermal stress generated by combustion and more effectively prevent a loss of strength of the cylinder head 15.

In still another form of the invention, the joint portion 16 is formed with a predetermined curvature. The reinforcing rib 19 is disposed so as to extend across an extended surface 22 formed continuously on a cylinder inner wall surface 20, and a space L between a reinforcing rib inner side surface 23 and the extended surface 22 is formed equal to or longer than the width of a radius of curvature R of the joint portion 16. A space L1 between a reinforcing rib outer side surface 24 and the extended surface 22 is formed equal to or greater than one-third of a thickness L2 of the cylinder upper end portion 12.

The purport of the thickness conditions of the reinforcing rib 19 in this form of the invention is as hereinafter described.

The range in which the stress of the load generated by combustion in the combustion chamber 18 formed in the cylinder 21 is concentrated on the joint portion 16 corresponds to the range over which the radius of curvature R of the joint portion 16 covers. Accordingly, the space L between the reinforcing rib inner side surface 23 and the above extended surface 22 must be formed equal to or greater than the radius of curvature R of the joint portion.

In addition, in order to sustain the stress acting on the joint portion 16 the instant of the combustion in the cylinder 12, analysis results reveal that one-third of the wall thickness of the cylinder upper end portion 12 during non-combustion is necessary. Therefore, it is necessary for the space L1 between the reinforcing rib outer side surface 24 and the above extended surface 22 to be formed equal to or greater than one-third the thickness of the cylinder upper end portion 12.

As a result, according to this form of the invention, when the stress by the combustion load generated in the combustion chamber 18 of the cylinder 21 acts on the joint portion 16, the stress is reliably retained by the joint portion 16 and the reinforcing rib 19. Further, the stress is input to the water jacket outer wall portion 14 through the reinforcing rib 19, and is hold also by the water jacket outer wall portion 14.

Accordingly, because it is possible to distribute and hold stress generated by a combustion load, the stress by combustion load does not concentrate on the joint portion 16. As a result, the joint portion 16 can sufficiently withstand the generated stress, such that a loss in strength in the joint portion 16 can be effectively prevented.

Moreover, since the above reinforcing rib 19 is joined to the water jacket outer wall portion 14, it is possible to effectively transfer the heat generated in the combustion chamber 18 to the water jacket 11 side, thereby preventing the cooling efficiency of the cylinder head 15 from decreasing.

DESCRIPTION OF THE PREFERRED EMBODIMENTS

Figure 1:
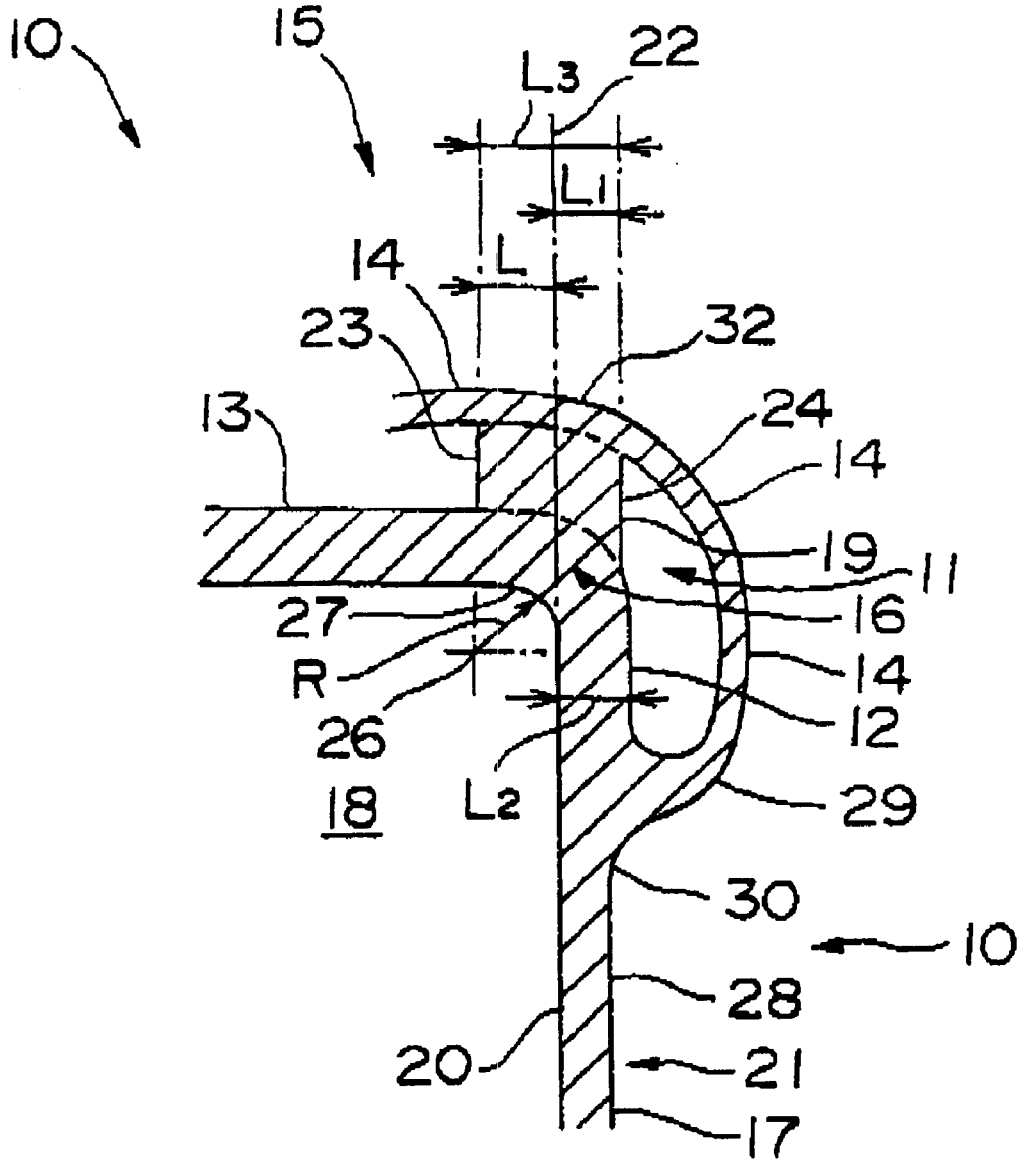
FIG. 1 is a sectional view schematically showing an embodiment of a mono-block cylinder head structure of a water cooled engine according to the present invention.

In this embodiment, there is shown as in FIG. 1 a mono-block cylinder structure of a water cooled engine.

In the mono-block cylinder structure according to this embodiment, a water jacket 11 is provided around the outer wall of the combustion chamber 18 of a mono-block cylinder 10. This water jacket 11 has a water jacket outer wall portion 14 covering a cylinder upper end portion 12 and a cylinder head ceiling portion 13, and a cooling liquid is stored in the inside, so as to enable cooling of the cylinder head 15.

The cylinder upper end portion 12 and the cylinder head ceiling portion 13 are joined at approximately right angles, and the joint portion 16 with the cylinder upper end portion 12 and the cylinder head ceiling portion 13 is formed with a predetermined radius of curvature.

Also, in the present embodiment, a reinforcing rib 19 which can hold the load generated by combustion in the combustion chamber 18 formed in the cylinder 21, as well as radiate the heat generated by the combustion to the water jacket 11 is formed at the joint portion 16 with the cylinder upper end portion 12 and the cylinder head ceiling portion 13.

This reinforcing rib 19 is provided in the water jacket 11, and is formed continuously rising from the cylinder upper end portion 12 at the joint portion 16 between the cylinder upper end portion 12 and the cylinder head ceiling portion 13, so as to join the space between the joint portion 16 and the water jacket outer wall portion 14.

The reinforcing rib 19 is disposed so as to extend across an extended surface 22 formed continuously in the axial direction of the cylinder 21 in a cylinder inner wall surface 20. The space L between the inner side surface 23 of the reinforcing rib 19 and the extended surface 22 is formed equal to or greater than the width of radius of curvature R forming the joint portion 16. The space L1 between an outer side surface 24 of the reinforcing rib 19 and the extended surface 22 is formed equal to or greater than one-third the thickness L2 of the cylinder upper end portion 12.

That is, the thickness L3 of the reinforcing rib becomes the sum of the thickness from the extended surface 22 of the cylinder inner wall surface 20 toward the inside of the cylinder from the extended surface 22 of the cylinder inner wall surface 20 and the thickness from the cylinder inner wall. surface toward the outside of the cylinder. The respective lengths are required to satisfy the following conditions:

(1) Thickness from the extended surface 22 of the cylinder inner wall surface 20 toward the inside of the cylinder.

To be equal to or greater than the width of radius curvature R from a terminal point 26 of the radius of curvature of the joint portion 16 between the cylinder upper end portion 12 and the cylinder head ceiling portion 13 to the joint portion inner peripheral surface 27.

(2) Thickness from the extended surface 22 of the cylinder inner wall surface 20 toward the outside of the cylinder To be of a length equal to or greater than one-third the thickness L2 of the cylinder upper end portion 12 forming the water jacket inner wall.

In this case, the purport of condition (1) above is that, because the range in which the stress is concentrated on the joint portion 16 of the load generated by combustion in the combustion chamber 18 in the cylinder 21 corresponds to the range until the radius of curvature R of the joint portion 16, at the very minimum this range must be ensured.

The purport of condition (2) above is that, in the same manner as in the cylinder 21 as the load generated by combustion, in order to reliably hold the load which acts on the joint portion 16 at the instance of combustion, analysis results reveal that it is necessary for the cylinder head ceiling portion 13 and the cylinder upper end portion 12 to be formed equal to or greater than one-third the thickness of the cylinder upper end portion 12 during non-combustion.

As a result, in the present embodiment, as shown in FIG. 1, the reinforcing rib outer side surface 24 is disposed in the approximately same position in the direction of cylinder diameter as the outer side surface 28 of the cylinder wall portion 17, while the reinforcing rib inner side surface 23 is disposed in the position separated by the width of the radius of curvature R of the joint portion 16 from the extended surface 22 of the cylinder inner wall surface 22.

Figure 2:
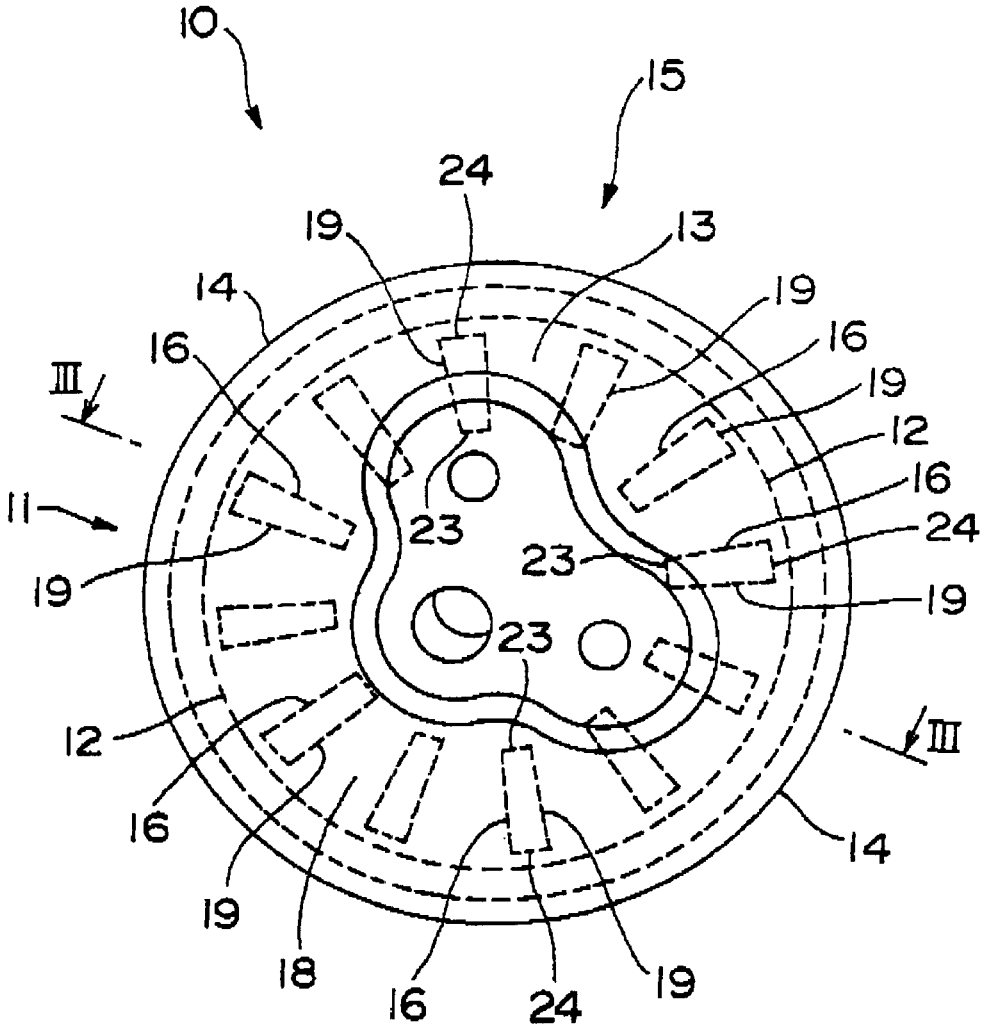
FIG. 2 is a plan view showing an embodiment of the mono-block cylinder head structure of a water cooled engine according to the present invention.
Figure 3:
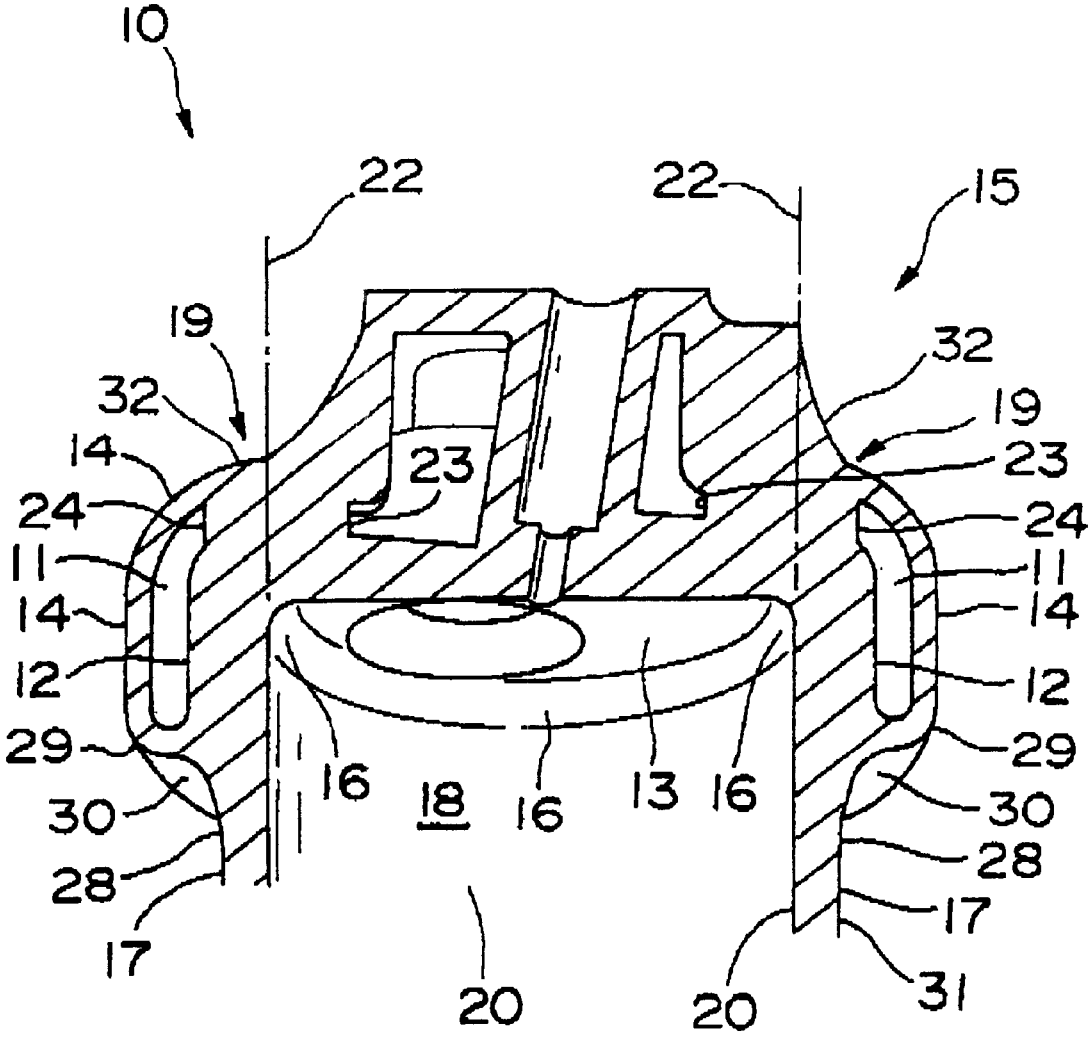
FIG. 3 is a sectional view showing an embodiment of the mono-block cylinder head structure of a water cooled engine according to the present invention, taken along line III—III in FIG. 2.

Also, in the present embodiment, as shown in FIG. 2 and FIG. 3, the reinforcing ribs 19 are disposed radially over the entire range in the peripheral direction of the combustion chamber 18 with predetermined intervals therebetween on the upper side of the cylinder head ceiling portion 13.

The functions of the mono-block cylinder head mechanism of water cooled engine according to this embodiment will hereinafter be described.

In the mono-block head structure of water cooled engine according to this embodiment, when a load generated by combustion acts as stress on the joint portion 16 when combustion takes place in the cylinder combustion chamber, that stress is hold by the joint portion 16 and the reinforcing rib 19, and further input to the water jacket outer wall portion 14 through the reinforcing rib 19. A lower end portion 29 of the water jacket outer wall portion 14 is, as shown in FIG. 1 and FIG. 3, at the upper end of the cylinder head 15, joined to the cylinder wall portion 17 in a position lower than the cylinder head ceiling portion 13 to form a joint portion 30, such that the stress transferred to the water jacket outer wall portion 14 is further transferred to the cylinder wall portion 17.

The stress by the combustion load is primarily hold in the reinforcing rib 19, and thereafter is further transferred to the water jacket outer wall portion 14. It is further hold in the joint portion 30 of the water jacket outer wall portion 14 with the cylinder wall portion 17. As a result, the combustion load becomes distributed to and hold in a plurality of locations on the cylinder head 15. Therefore, the stress by combustion load acting on the joint portion 16 can be alleviated.

Consequently, in the present embodiment, the stress generated in combustion is distributed and absorbed without being concentrated on the joint portion 16.

In addition, because the reinforcing rib 19 is joined to the water jacket outer wall portion 14, it can effectively transfer heat generated in the combustion chamber 18, so that the heat transferred to the reinforcing rib 19 is not confined in the reinforcing rib 19, and the heat resistance strength of the reinforcing rib 19 and the joint portion 16 per se can be ensured.

Further, because the heat is transferred to the water jacket outer wall portion 14 by the reinforcing rib 19, cooling can be conducted by dissipating the heat of the cylinder head 15, such that the cooling efficiency of the entire cylinder head 15 can be improved.

Moreover, in the mono-block head structure of water cooled engine according to this embodiment, as shown in FIG. 2, on the cylinder head ceiling portion 13, the reinforcing ribs 19 are provided radially over the entire area of the combustion chamber 18 with predetermined intervals therebetween in the water jacket 11. Therefore, a plurality of reinforcing ribs 19 disposed radially hold the combustion load generated at the central portion in the combustion chamber 18, and further, transfer that stress radially to the water jacket outer wall portion 14. As a result, the stress by the generated combustion load can be reliably distributed and hold.

Furthermore, in the mono-block cylinder head structure of a water cooled engine according to the above embodiment, the die molding property during casting of the cylinder block can be improved.

That is, when casting a conventional mono-block cylinder head 46 by die molding, molten metal is poured into a mold from the direction of the lower part of the mono-block cylinder. In this case, as the cylinder head portion 47 is in a position separated by a distance from the pouring in point of the molten metal, the pressure of the poured molten metal gradually lowers.

In addition, because of the constitution is such that the water jacket 11 formed on the cylinder head 15 is to be molded into a thinner wall thickness than the cylinder head body portion 31, there have been cases in which the molten metal channel formed in the die for forming the water jacket outer wall portion 50 is narrow and the molten metal does not spread sufficiently, making it difficult to make a complete die molding.

However, in the mono-block cylinder head structure of a water cooled engine according to this embodiment, as shown in FIG. 1 and FIG. 3, since the reinforcing ribs 19, 25 are formed between the water jacket outer wall portion 14 and the cylinder head ceiling portion 13, a direct molten metal channel is formed from the cylinder upper end portion 12 to the upper surface 32 of the water jacket outer wall portion 14, so that the molten metal easily spreads over the water jacket outer wall portion 14, thus making it possible to reliably perform die molding of the water jacket outer wall portion 14.

Figure 4:
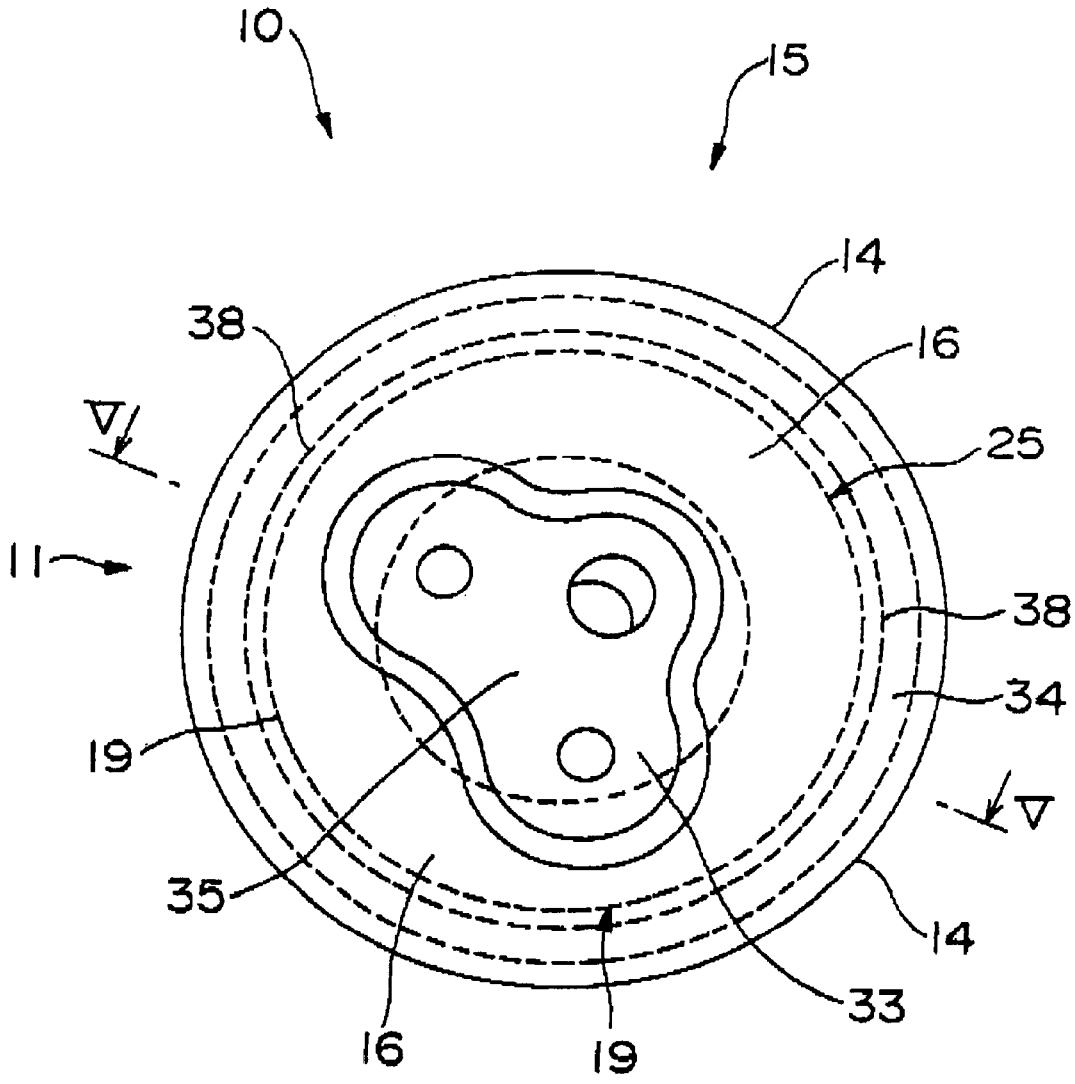
FIG. 4 is a plan view showing another embodiment of the mono-block cylinder head structure of a water cooled engine according to the present invention.
Figure 5:
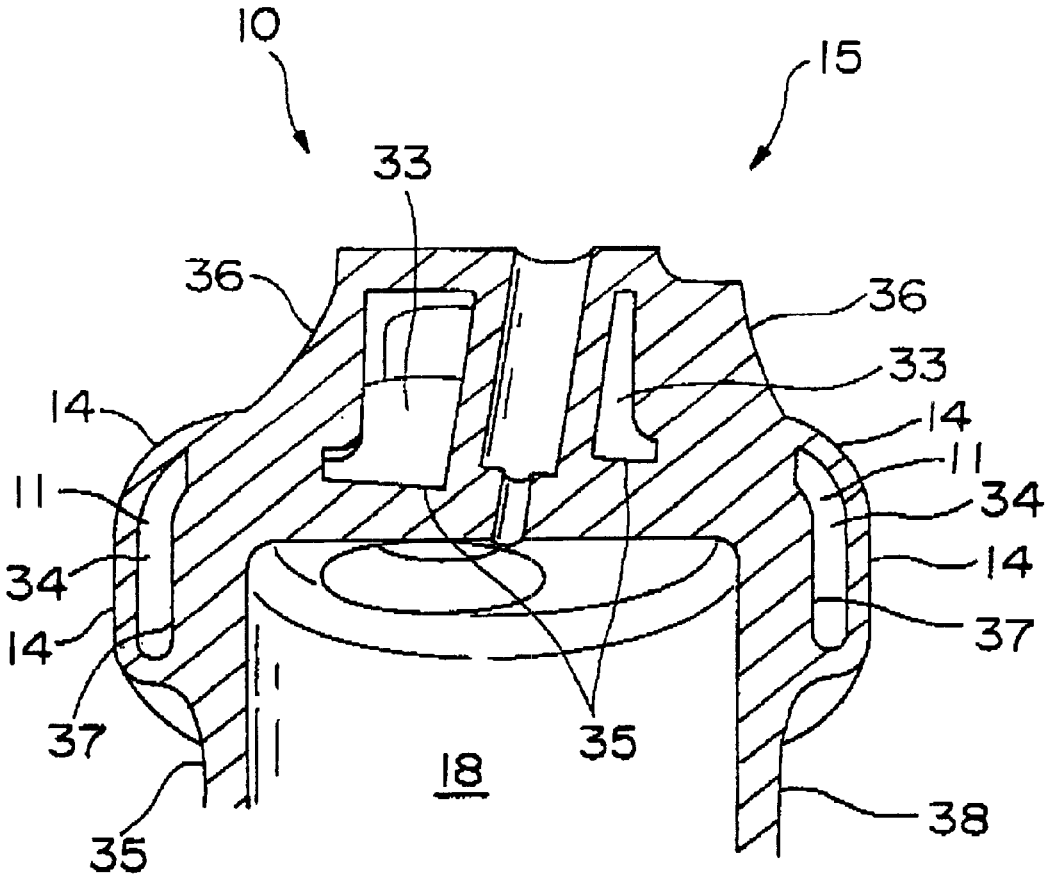
FIG. 5 is a sectional view showing an embodiment of the mono-block cylinder head structure of a water cooled engine according to the present invention, taken along line V—V in FIG. 2.
Figure 6:
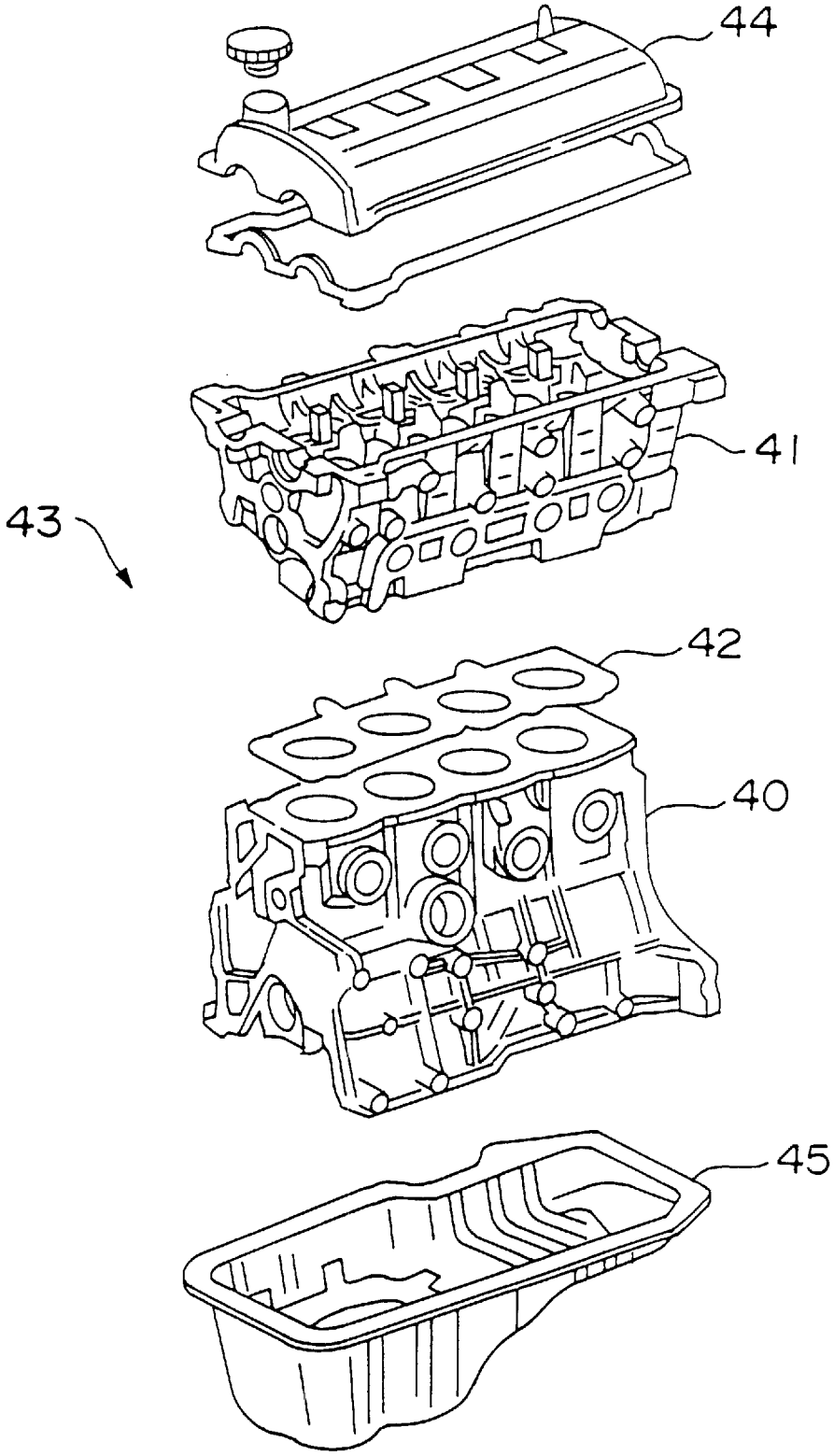
FIG. 6 PRIOR ART
FIG. 6 is an exploded perspective view showing in general the structure of an engine body in an exploded state.
Figure 7:
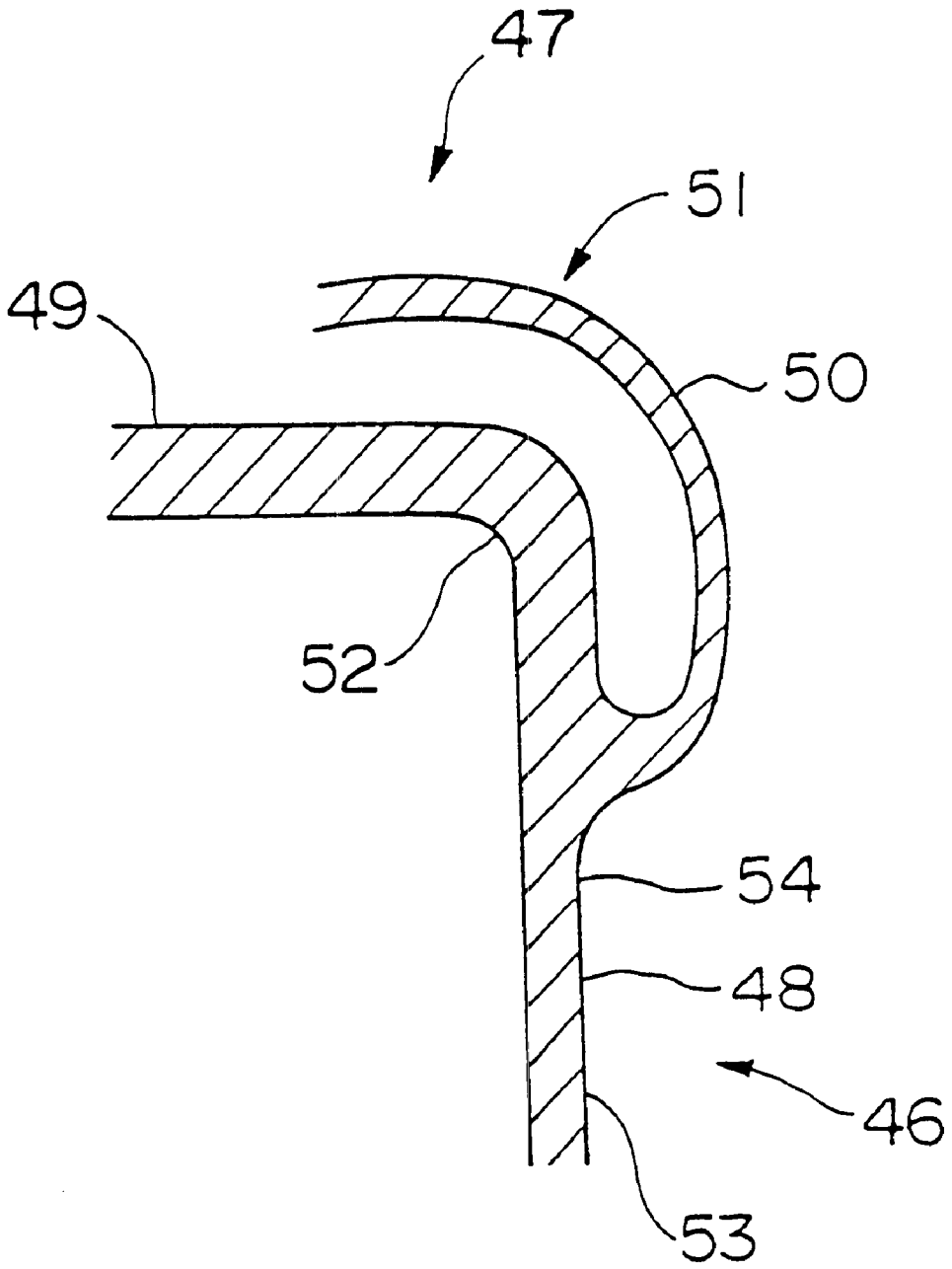
FIG. 7 PRIOR ART
FIG. 7 is a sectional view schematically showing a conventional mono-block cylinder head structure.

The foregoing embodiment was described using an example in which the reinforcing ribs 19 are provided radially over the entire area of the combustion chamber 18 with predetermined intervals therebetween. However, the invention is not limited to this embodiment but as shown in FIG. 4, the reinforcing ribs 25 may be formed in a planar annulus ring shape continued over the entire area in the peripheral direction of the cylinder head ceiling portion 13 on the outside of the cylinder head ceiling portion 13. The water jacket 11 may be formed divided into the inner water jacket portion 33 and the outer water jacket portion 34, such that the cooling liquid in the inner water jacket portion 33 can circulate in the outer water jacket portion 34.

Accordingly, in the mono-block cylinder head structure of the water cooled engine according to the present embodiment, the cooling liquid in the water jacket 11 is first supplied to the inner water jacket portion 33 disposed on the cylinder head ceiling wall central portion 35 to cool the cylinder head ceiling wall central portion 35. Thereafter, the cooling liquid, whose temperature has been elevated to a predetermined temperature by heat exchange, is circulated to the outer water jacket portion 34 disposed on the side portion of the cylinder head 15 to cool a cylinder upper end portion 37.

In this case, the cylinder upper end portion 37 has a relatively low combustion temperature compared with the cylinder head ceiling wall central portion 35. Accordingly, even when the cooling liquid temperature has risen to a predetermined temperature, the cooling action is not impaired.

As a result, it is possible to achieve sufficient cooling by supplying cooling liquid of the lowest temperature to the cylinder head ceiling wall central portion 35 which has the highest temperature and the greatest need for cooling, while supplying cooling liquid of a comparatively not so low temperature to the cylinder upper portion 37 wherein the temperature does not become as high as in the cylinder head ceiling wall central portion 35, thereby making it possible to improve the cooling efficiency of the cylinder head 15.

Furthermore, as the cooling liquid that cooled the cylinder head ceiling wall central portion 35 on the upper part of the cylinder head 15 of the water jacket 11 can be supplied directly to the cylinder upper end portion 37 to cool the cylinder head 15, the cooling liquid can be effectively utilized to efficiently cool the cylinder head.

Also, as described above, it is possible to achieve sufficient cooling by supplying the cooling liquid of the lowest temperature to the cylinder head ceiling wall central portion 35 which has the highest temperature and the greatest need for cooling, while supplying the cooling liquid of not so low a temperature to the peripheral portion 38 of the cylinder head wherein the temperature does not become as high as in the cylinder head ceiling wall central portion 35. As a result, it becomes possible to make the thermal distribution in the combustion chamber 18 uniform by cooling, such that it is possible to aim to alleviate uneven generation of thermal stress generated by combustion.

What is claimed is:

1. A mono-block engine having a cylinder head structure provided with a water jacket having a waterjacket outer wall, said water jacket outer wall covering an engine cylinder upper end portion and a cylinder head ceiling portion, comprising vertically extended reinforcing ribs provided parallel with the axis of the cylinder, which can hold a load generated by combustion in a combustion chamber formed in said cylinder and which can release heat generated by said combustion to the water jacket.

2. A mono-block engine having a cylinder head structure provided with a water jacket having a water jacket outer wall covering said cylinder upper end portion and a cylinder head ceiling portion according to claim 1, comprising said reinforcing ribs, which are formed continuously rising from said cylinder upper end portion in a joint portion between said cylinder upper end portion, and said cylinder head ceiling portion in said water jacket, for joining a space between said joint portion and a water jacket outer wall.

3. A mono-block engine having a cylinder head structure according to claim 2, wherein said reinforcing ribs are disposed radially in a plane over an entire area in a peripheral direction of said combustion chamber with predetermined intervals therebetween.

4. A mono-block engine having a cylinder head structure according to claim 2, wherein said reinforcing ribs are formed in a continuous planar annular ring shape over the entire area in the peripheral direction of the cylinder head ceiling portion on the outside thereof; said water jacket is formed divided into an inner water jacket portion and an outer water jacket portion; and a cooling liquid for said inner water jacket portion is able to circulate in said outer water jacket portion.

5. A mono-block engine having a cylinder head structure according to claim 1 wherein: a joint portion between said cylinder upper end portion, and said cylinder head ceiling portion is formed with a predetermined curvature; said reinforcing ribs are disposed so as to extend across an extended surface formed continuously on a cylinder inner wall surface; and a space between a reinforcing rib inner side surface and said extended surface is formed equal to or greater than the radius of curvature of said joint portion, while a space between a reinforcing rib outer side surface and said extended surface is formed equal to or greater than one-third the thickness of said cylinder upper end portion.

6. A mono-block engine having a cylinder head structure according to claim 2, wherein; said joint portion is formed with a predetermined curvature; said reinforcing ribs are disposed so as to extend across an extended surface formed continuously on a cylinder inner wall surface; and a space between a reinforcing rib inner side surface and said extended surface is formed equal to or greater than the radius of curvature of said joint portion, while a space between a reinforcing rib outer side surface and said extended surface is formed equal to or greater than one-third the thickness of said cylinder upper end portion.

7. A mono-block engine having a cylinder head structure according to claim 3, wherein; said joint portion is formed with a predetermined curvature; said reinforcing ribs are disposed so as to extend across an extended surface formed continuously on a cylinder inner wall surface; and a space between a reinforcing rib inner side surface and said extended surface is formed equal to or greater than the radius of curvature of said joint portion, while a space between a reinforcing rib outer side surface and said extended surface is formed equal to or greater than one-third the thickness of said cylinder upper end portion.

8. A mono-block engine having a cylinder head structure according to claim 4, wherein; said joint portion is formed with a predetermined curvature; said reinforcing ribs are disposed so as to extend across an extended surface formed continuously on a cylinder inner wall surface; and a space between a reinforcing rib inner side surface and said extended surface is formed equal to or greater than the radius of curvature of said joint portion, while a space between a reinforcing rib outer side surface and said extended surface is formed equal to or greater than one-third the thickness of said cylinder upper end portion.

* * * * *